US005881506A

United States Patent [19]

Chapman et al.

[11] Patent Number: 5,881,506

[45] **Date of Patent: *Mar. 16, 1999**

[54] GROUND ANCHOR

[76] Inventors: James P. Chapman, 16026 Pool Canyon Rd., Austin, Tex. 78734; Paul N. McKim, 5405 Merrywing Cir., Austin, Tex. 78730

[ * ] Notice: The term of this patent shall not extend beyond the expiration date of Pat. No. 5,625,984.

[21] Appl. No.: 813,823

[22] Filed: Mar. 6, 1997

Related U.S. Application Data

[63] Continuation-in-part of Ser. No. 399,765, Mar. 7, 1995, Pat. No. 5,625,984.

[51] Int. Cl.[6] ..... E02D 5/80

[52] U.S. Cl. ..... 52/166; 52/163; 405/259.1

[58] Field of Search ..... 52/162, 163, 166, 52/165, 153, 154, 155; 405/238, 248, 259.1

[56] References Cited

U.S. PATENT DOCUMENTS

| | | |
|---|---|---|
| 1,376,854 | 5/1921 | Bearse . |
| 2,784,815 | 3/1957 | Larson . |
| 2,841,256 | 7/1958 | Clevett, Jr. . |
| 3,888,057 | 6/1975 | Zubke . |
| 3,969,854 | 7/1976 | Deike . |
| 4,023,314 | 5/1977 | Tanner . |
| 4,096,673 | 6/1978 | Deike . |
| 4,300,857 | 11/1981 | Santamaria . |
| 4,611,446 | 9/1986 | Beavers et al. . |
| 4,688,360 | 8/1987 | Luong et al. . |
| 4,727,693 | 3/1988 | Rockenfeller et al. . |
| 4,738,063 | 4/1988 | Alsop . |
| 4,802,317 | 2/1989 | Chandler . |
| 5,031,370 | 7/1991 | Jewett . |
| 5,050,355 | 9/1991 | Pildysh . |
| 5,171,108 | 12/1992 | Hugron . |
| 5,175,966 | 1/1993 | Remke et al. . |

FOREIGN PATENT DOCUMENTS

| | | |
|---|---|---|
| 577784 | 1/1982 | Japan . |

*Primary Examiner*—Michael Safavi
*Attorney, Agent, or Firm*—Baker & Botts, L.L.P.

[57] ABSTRACT

An anchor (100) for anchoring a structure to the ground includes a cylindrical section (102), an anchor shank (104), and an anchor body (106). The cylindrical section has a driving surface (108) and a hole (112) and is connected to the anchor shank (104) at an attachment point (110). The anchor shank (104) has a connection feature (114) and a pivot slot (122), wherein the anchor body (106) is pivotally coupled to the anchor shank (104) at the pivot slot (122). The anchor body (106) has an angled portion (126) for engaging the ground when the anchor is set and a leading edge (128). The anchor (100) has a pre-set state in which the anchor body (106) is parallel with the anchor shank (104) and a set state in which the anchor body (106) is no longer parallel with the anchor shank (104).

20 Claims, 8 Drawing Sheets

GROUND ANCHOR

CROSS-REFERENCE TO RELATED APPLICATION

This application is a continuation-in-part of U.S. patent application Ser. No. 08/399,765, filed Mar. 7, 1995 by James P. Chapman, and entitled "Ground Anchor," pending.

TECHNICAL FIELD OF THE INVENTION

This invention relates generally to anchoring systems, and more particularly to a ground anchor.

BACKGROUND OF THE INVENTION

Ground anchors are used in a wide variety of applications, both on dry land and under water, for example in anchoring antennae or floating structures, such as docks.

Ground anchors are generally driven lengthwise into the ground (either directly or through pre-drilled holes) and then pulled upward when the desired depth has been reached. The pulling action results in tilting the anchor into a transverse position for the anchoring function. The tilting occurs about a pivot point. With prior art anchors, a connection feature (such as a socket, padeye, or shackle, among others) is formed at the pivot point for coupling to a connecting rod, cable, or chain ("connecting member"). The connecting member connects the anchored structure to the anchor.

Such prior art anchors are exemplified in the following United States patents: U.S. Pat. No. 5,171,108 issued to Hugron on Dec. 15, 1992; U.S. Pat. No. 5,050,355 issued to Pildysh on Sep. 24, 1991; U.S. Pat. No. 5,031,370 issued to Jewett on Jul. 16, 1991; U.S. Pat. No. 4,802,317 issued to Chandler on Feb. 7, 1989; U.S. Pat. No. 4,738,063 issued to Alsop on Apr. 19, 1988; U.S. Pat. No. 4,727,693 issued to Rockenfeller, et al. on Mar. 1, 1988; U.S. Pat. No. 4,688,360 issued to Luong, et al. on Aug. 25, 1987; U.S. Pat. No. 4,611,446 issued to Beavers, et al. on Sep. 16, 1986; U.S. Pat. No. 4,096,673 issued to Deike on Jun. 27, 1978; U.S. Pat. No. 3,969,854 issued to Deike on Jul. 20, 1976; and U.S. Pat. No. 3,888,057 issued to Zubke on Jun. 10, 1975. These patents are herein incorporated by reference.

With prior art anchors, the bulk of material needed to form the connection feature is added to the pivot point. Because the pivot point often has a significant cross-section in and of itself, the addition of the connection feature results in an even larger cross section. Such large cross sections result in difficult insertion of anchors into the ground, and often require the drilling of holes of diameters sufficient to accommodate the cross section of the combination pivot point and the connection feature.

Furthermore, the weakest point of a ground anchor is generally at the pivot point, since this is where force is exerted between the connecting member and the anchor. Therefore, the strength of the anchor will generally be determined by the type of material and geometry of the pivot point. With prior art systems, the connecting member is attached at the pivot point, and thus the connection feature is formed at the pivot point. Such features can reduce anchor strength, since they are formed at the weakest point, unless the anchor is appropriately sized up.

Therefore, a need has arisen for a ground anchor that is relatively stronger for its size than prior art anchors, thus allowing for easier driving of the anchor into the ground. In particular, a need has arisen for a ground anchor that can be driven into narrower holes, since narrower holes can be drilled into the ground more quickly and at less cost than wider holes.

SUMMARY OF THE INVENTION

Accordingly, a ground anchor is provided herein which substantially eliminates or reduces disadvantages and problems associated with prior art ground anchors. In particular, an anchor is provided for anchoring a structure to the ground, the anchor coupled to the structure through a connecting member. The anchor includes a cylindrical section having a driving surface attached to an anchor shank which is pivotally connected to an anchor body. The anchor shank includes a connection feature which is positioned remote from the pivotal connection with the anchor body. This remote connection allows for a ground anchor which is smaller in cross section than anchors of comparable strength.

The anchor has a pre-set state in which the anchor body is parallel to the anchor shank and which allows for the anchor to be inserted into the ground. Once inserted into the ground to the desired depth, the anchor body is caused to pivot such that a set state is achieved in which the anchor body is no longer parallel with the anchor shank.

A technical advantage of the present invention is the reduced cost and complexity achieved by making the components of the anchor such that the majority may be cut from a sheet of metal and assembled in a simple, lowcost manner.

Another technical advantage of the present invention is the formation of prongs at one end of the anchor body, where the prongs are angled away from one another with respect to the plane of the anchor body.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE INVENTION

The preferred embodiments of the present invention and its advantages are best understood by referring to FIGS. 1 through 15 of the drawings, like numerals being used for like and corresponding parts of the various drawings.

Figure 1:
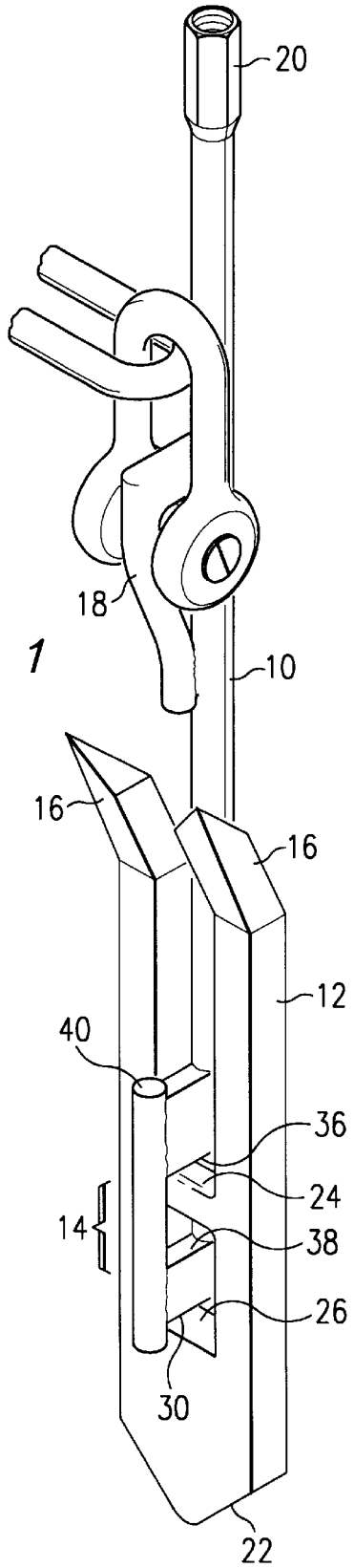
FIG. 1 illustrates a perspective view of a ground anchor according to the teachings of the present invention.

FIG. 1 illustrates a perspective view of a ground anchor according to the teachings of the present invention. The ground anchor of the present invention may be made of any suitable material, including, but not limited to, cast iron, stainless steel, or any combination of suitable materials or alloys. As shown in FIG. 1, the ground anchor of the present invention includes an anchor shank 10 pivotally connected to an anchor body 12 at pivot point 14. Anchor body 12 includes end 16. End 16 initiates, upon pulling of the anchor after it has been inserted in the ground, the pivoting of anchor body 12. In particular, end 16 engages with the ground upon the pulling operation, resulting in the pivotal action.

Also shown in FIG. 1 is padeye 18 formed on anchor shank 10 remote from pivot point 14. Padeye 18 provides a connection feature for coupling a connecting member (a chain is illustrated in the FIGUREs) to the anchor. The connecting member is used to connect the anchor to the structure to be anchored. It should be understood that any type of connecting member, such as a rod, cable, chain, or any other suitable connection member, can be used for connecting the ground anchor of the present invention with the structure to be anchored. Thus, the padeye 18 shown in FIG. 1 is exemplary only, and other types of connection features, such as screw fittings for threaded connecting rods, or any other type of connection fitting, can be used without departing from the intended scope of the present invention. It is important only that the connection feature be remote from the pivot point 14.

By providing a connection point that is remote from the pivot point 14, the present invention provides a significant advantage over prior art systems. In particular, the bulk of material required to form the connection feature (such as padeye 18) is placed remote from the pivot point 14, and therefore the cross section of the ground anchor of the present invention (for purposes of insertion) is greatly reduced over that of prior art systems. This advantage results because the pivot point of a typical ground anchor has a significant cross section in and of itself, and thus placing the connection point at the pivot point, as in prior art systems, presents an even larger cross section. With the present invention, the cross section attributable to the connection feature is placed "in line" with that of the pivot point, and is thus not added to that of the pivot point. Therefore, the anchor of the present invention can be inserted into the ground more easily, and in particular into holes of smaller diameters, than prior art systems. The ability to be inserted into holes of smaller diameters provides a significant advantage, since smaller holes can be drilled for less cost and more quickly than wider holes. The present invention provides cross sectional reductions over anchors of comparable strength on the order of fifty percent or more.

Figure 2:
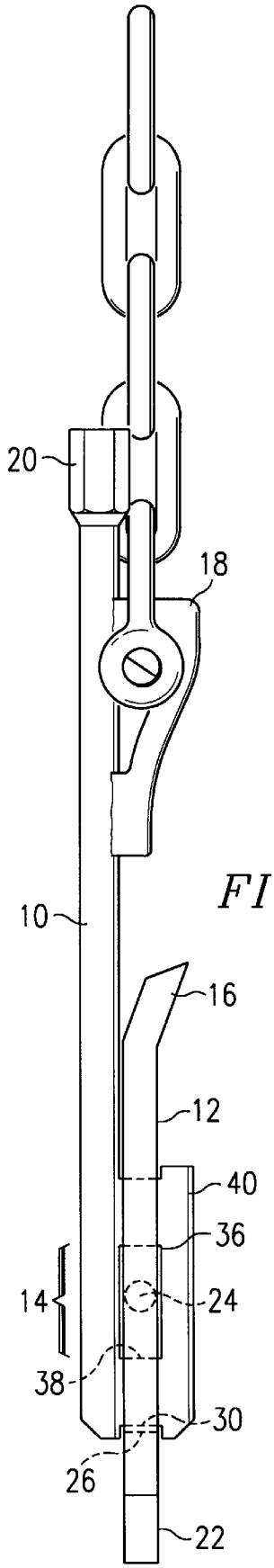
FIG. 2 illustrates a side view of a ground anchor according to the teachings of the present invention before the anchor is set.
Figure 3:
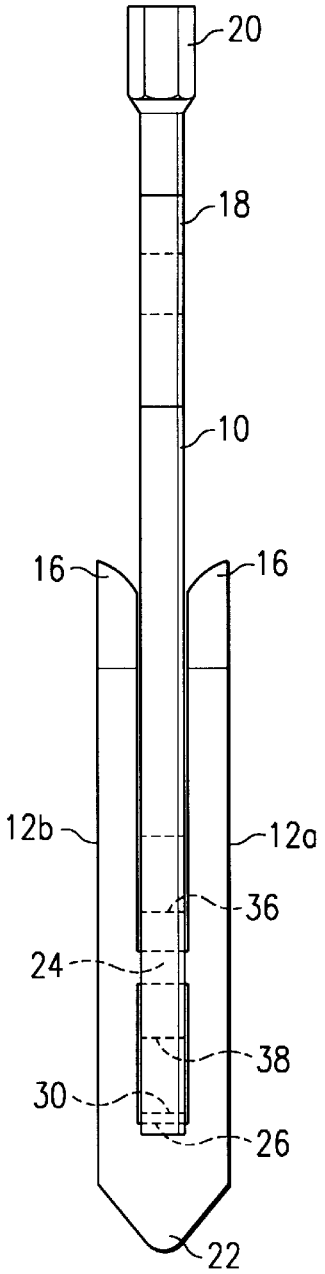
FIG. 3 illustrates a front view of a ground anchor according to the teachings of the present invention before the anchor is set.
Figure 4A:
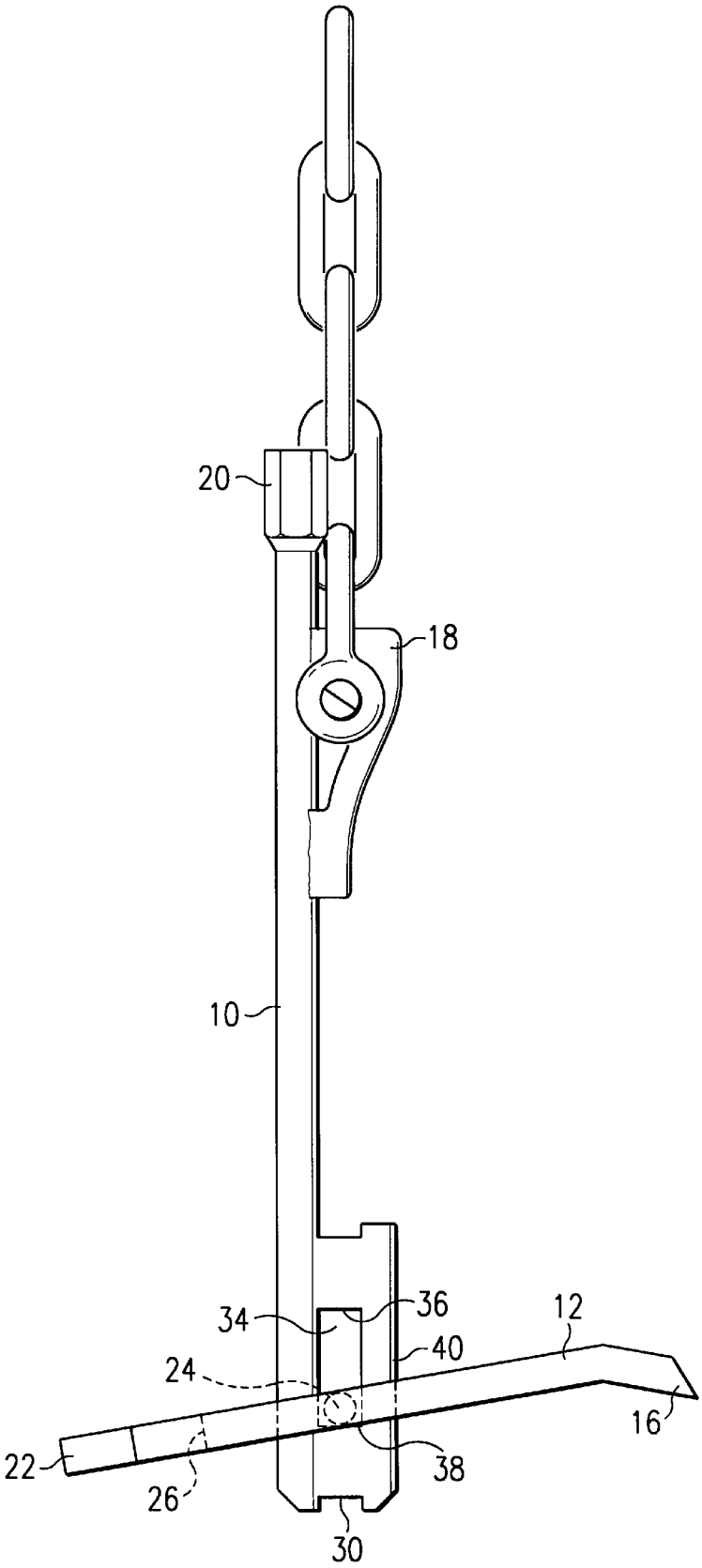
FIG. 4A illustrates a side view of a ground anchor according to the teachings of the present invention after the anchor is set.
Figure 5:
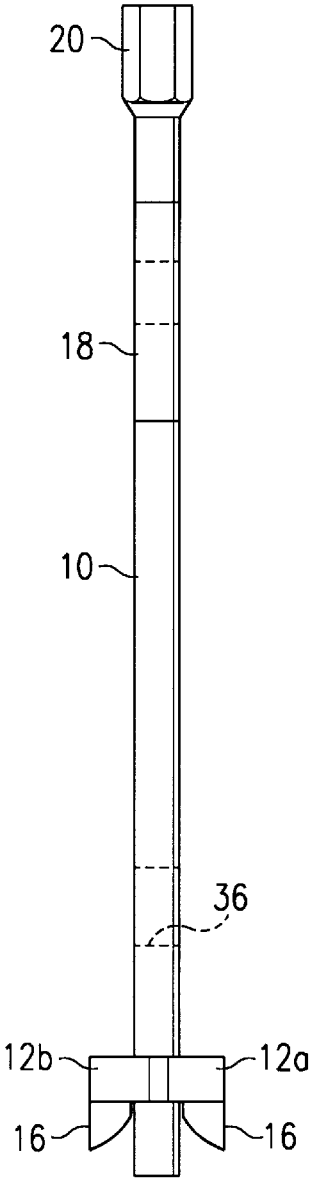
FIG. 5 illustrates a side view of a ground anchor according to the teachings of the present invention after the anchor is set.

FIGS. 2–6 illustrate particular views of a ground anchor according to the teachings of the present invention. FIGS. 2 and 3 illustrate the anchor before it has been set, while FIGS. 4A and 5 illustrate the anchor after it has been set. As shown in these FIGUREs, the anchor shank 10 includes a socket 20 for use in coupling an applicator (insertion device) to the anchor shank 10, for use in driving the ground anchor into the ground. Socket 20 may be any suitable fitting or socket, such as a threaded fitting for use with an applicator to be discussed below in connection with FIG. 7, or a socket for directly receiving a driving device, such as a jackhammer.

As shown in the FIGUREs, anchor body 12 includes a leading end 22 which joins anchor body members 12*a* and 12*b*. Leading end 22 may be beveled, pointed, or angled to accommodate insertion into the ground. Anchor body 12 also includes a pivot pin 24 for providing the pivotal connection with anchor shank 10. Pivot pin 24 may be formed integrally with or separate from anchor body 12. Leading end 22 includes an anchor body shoulder 26. Shoulder 26 engages with a recessed driving shoulder 30 of anchor shank 10. The recessed driving shoulder 30 allows the anchor body 12 to "lock" into anchor shank 10 during insertion of the ground anchor into the ground, thereby avoiding premature pivoting of the anchor body 12 about anchor shank 10.

The pivot pin 24 of anchor body 12 pivots within pivot pin slot 34 of anchor shank 10. This pivot pin slot 34 is defined by pivot pin upper and lower shoulders 36 and 38 and slot cap 40. Anchor shank 10 and slot cap 40 extend beyond recessed shoulder 30.

Because of the recessed driving shoulder 30 discussed above, the pivotal connection between the anchor shank 10 and anchor body 12 of the present invention provides an important technical advantage. In particular, during insertion or driving of the anchor into the ground, the anchor body 12 "locks" into anchor shank 10, thus avoiding premature setting of the anchor. However, it should be understood that this feature need not be included. Furthermore, other locking mechanisms could be used without departing from the intended scope herein.

Furthermore, other types of pivotal connections between the anchor shank 10 and anchor body 12 may be used without departing from the intended scope herein. For example, anchor shank 10 could be forked, with anchor body 12 pivoting between the forks of anchor shank 10.

Figure 4B:
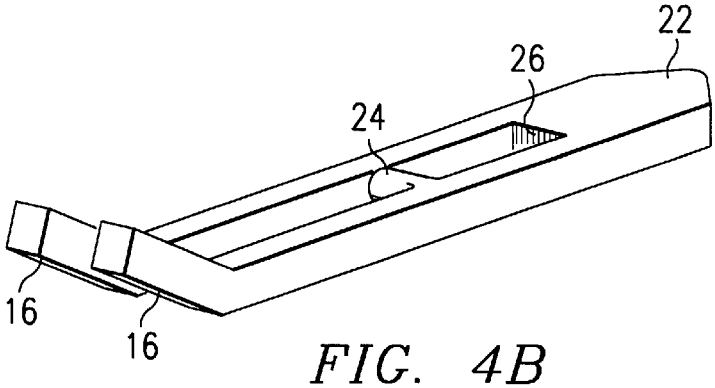
FIGS. 4B and 4C illustrate details of particular embodiments of an anchor body according to the teachings of the present invention.

As shown in FIGS. 4A and 4B, anchor body members 12*a* and 12*b* are angled at ends 16. As shown in FIG. 4A, these ends may be beveled, or, as shown in FIG. 4B, need not be beveled. By beveling the end 16, the ground anchor of the present invention can be more quickly set upon the pulling action. The anchor members 12*a* and 12*b* may also be joined at or near the end 16 to increase strength.

Figure 4C:
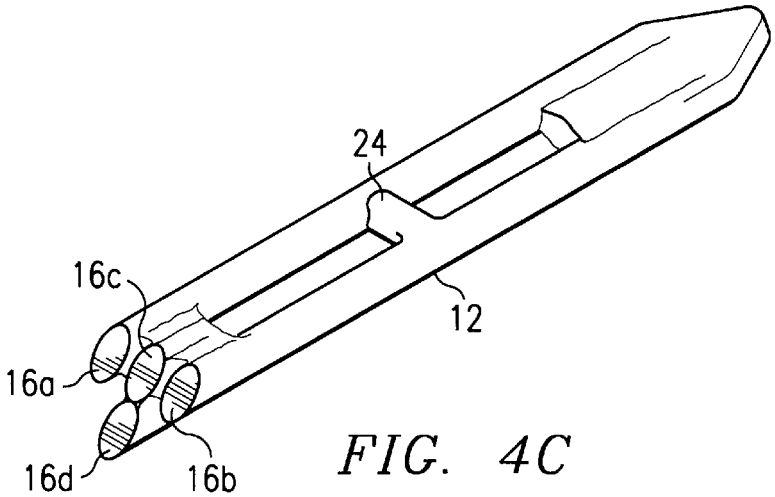
Figure 6:
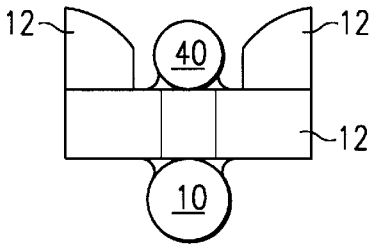
FIG. 6 illustrates a cross-sectional view of a ground anchor according to the teachings of the present invention.

FIG. 4C illustrates another alternative for anchor body end 16, in which several ends 16*a*–16*d* are presented to reduce overall insertion cross sectional area. Rather than angling the end 16, the thickness of end 16 is built up with end 16*d* to ensure engagement with the ground during anchor setting. The end 16 shown in FIG. 4C may also be beveled to improve ground-engagement. The members 16*a*–16*d* need not be separate, but can be formed as one end. Moreover, the shape or thickness of the end 16 may be varied to embodiments other than those shown in FIGS. 4A–4C.

Figure 7:
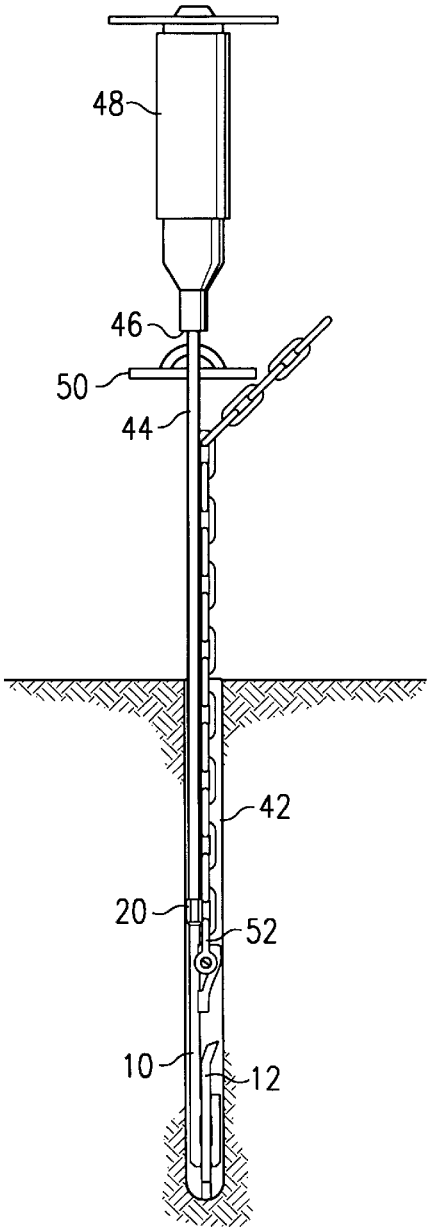
FIG. 7 illustrates insertion of a ground anchor according to the teachings of the present invention.

FIG. 7 illustrates insertion of the ground anchor according to the teachings of the present invention. As shown in FIG. 7, a pre-drilled hole 42 is provided into which the ground anchor is inserted, although no pre-drilled hole is needed. An applicator tool 44 may be coupled to anchor shank 10, for example at socket 20. This applicator tool 44 includes a socket 46 for receiving a driving tool, such as a jackhammer 48. Applicator tool 44 also includes outwardly extending stop 50.

In operation, the hole 42 is drilled, and applicator tool 44 is coupled to anchor shank 10. Also, the connecting member for connecting the anchor to the structure to be anchored is coupled to the anchor shank 10. In a particular example, this connecting member may be a chain connected to padeye 18, with a shackle 52. The driving instrument, such as jackhammer 48, is coupled to the applicator tool and used to drive the anchor into the pre-drilled hole 42. Once the anchor is inserted to the desired depth, the applicator tool 44 is disengaged from anchor shank 10, such as by unscrewing it. The anchor is then set by pulling on the connecting member, such as the chain shown in FIG. 7. As discussed above, this pulling operation results in the end 16 of anchor body 12 engaging with the ground, thus resulting in the pivoting of anchor body 12 to a transverse position (as shown in FIGS. 4A and 5).

The use of applicator tool 44 allows for the ground anchor to be inserted to a greater depth than if the drive instrument were coupled directly to the ground anchor. However, it should be understood that the applicator tool is not necessary, and the drive instrument can be coupled directly to the anchor shank 10. Furthermore, as discussed above, applicator tool 44 may include a stop 50. The stop 50 extends out from the applicator tool and should be of a size that is wider than the diameter of the hole 42. This stop operates to stop insertion of the ground anchor once the stop reaches the ground. In this way, the desired depth of the anchor can be insured.

Figure 8:
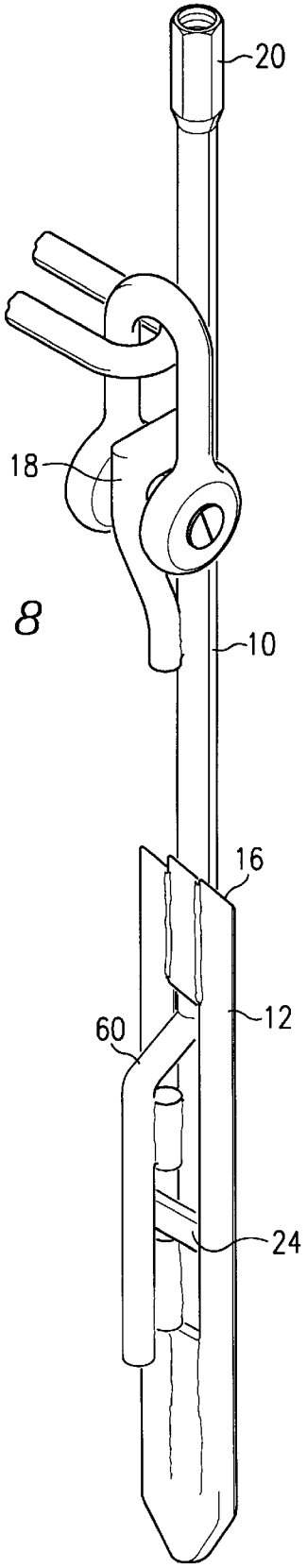
FIG. 8 illustrates a perspective view of another embodiment of a ground anchor according to the teachings of the present invention.

FIG. 8 illustrates a perspective view of an alternative embodiment of the present invention, in which an angled shoulder 60 is provided on anchor shank 10. With this embodiment, members 12*a* and 12*b* are joined at end 16. Angled shoulder 60 facilitates pivoting of anchor body 12 because it is angled in the direction end 16 pivots. In particular, when the end 16 engages with the ground during setting of the anchor, the angled shoulder 60 contacts the inside shoulder of end 16 and directs anchor body 12 in the pivoting direction.

Figure 9:
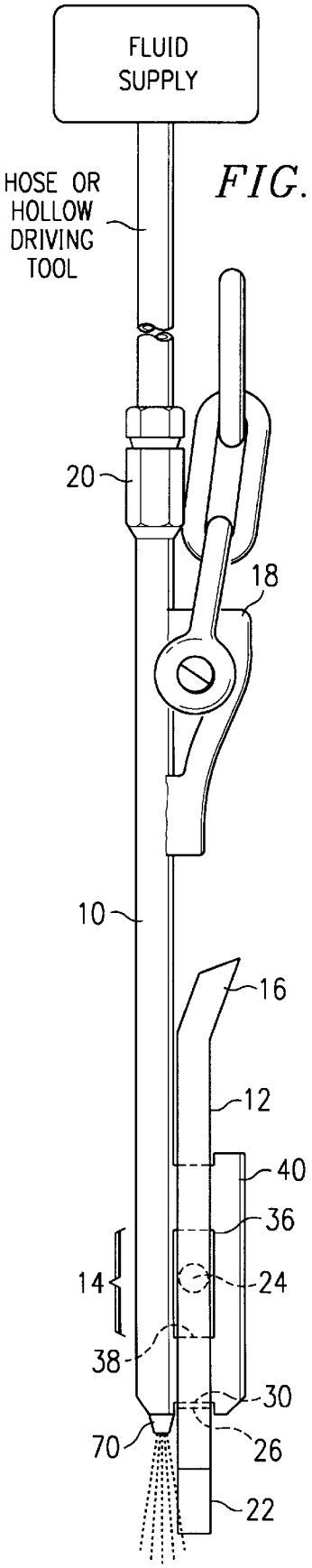
FIGS. 9–10 illustrate embodiments allowing for jetting operations according to the present invention.
Figure 10:
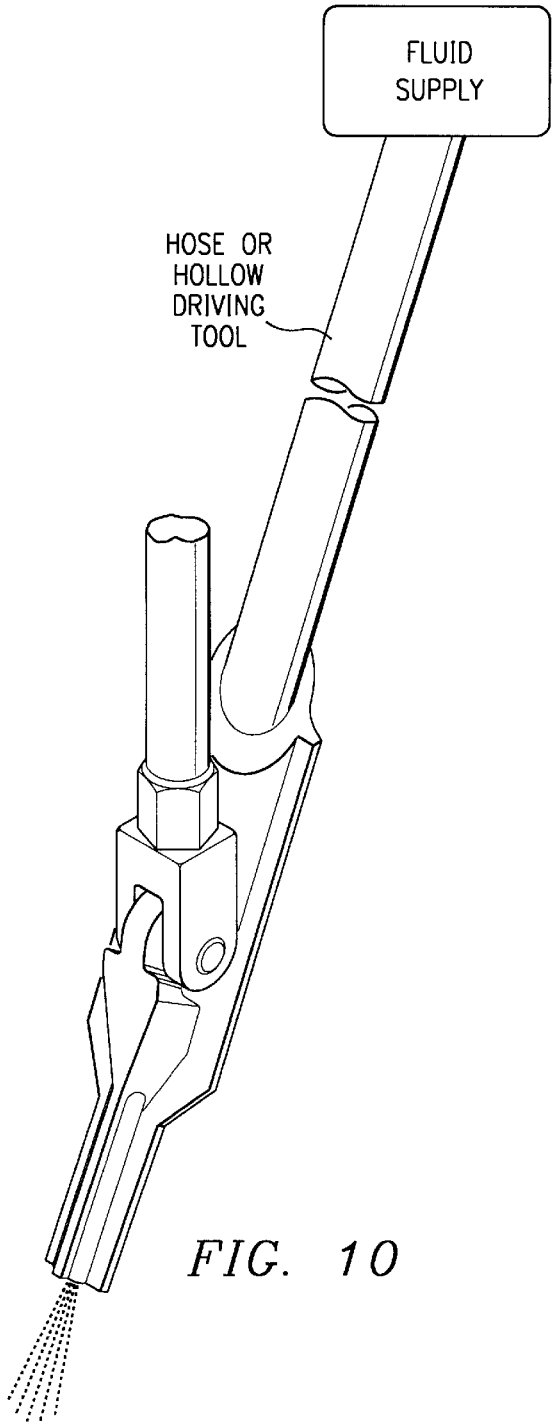

In another embodiment, shown in FIG. 9, anchor shank 10 is hollow, and includes an open end 70 (or nozzle), to facilitate jetting operations. By "hollow" it is meant that the piece has a channel or other void allowing for the flow of a fluid. A supply of water or air (or other fluid) is coupled to socket 20 to supply a fluid through the anchor shank 10 and end 70. This fluid supply can be supplied through a hose or hollow driving tool, or other possible supply couplings. This process assists in clearing a passage through the ground for insertion of the anchor. This jetting capability simplifies anchor insertion in many soil conditions that have previously presented significant difficulties, such as sand, clay, and mud. Indeed, the jetting advantage can be implemented without an anchor shank, for example with certain prior art anchor systems. To take advantage of the present invention's jetting capability to improve prior art anchors, the prior art anchor pieces can be hollowed and adapted to couple with a water or air supply, as shown in FIG. 10. For example, a driving tool used to drive the anchor of FIG. 10 can be hollowed to allow a fluid to pass through the driving tool and hollowed anchor piece. Alternatively, the fluid supply can be coupled directly to the hollow anchor piece, for example with a hose, and the anchor can then be driven with the connecting member.

The ability to supply fluids for jetting operations avoids the need in many cases for machinery needed for driving, such as hydraulic or pneumatic hammers, and the associated hydraulic or pneumatic systems.

FIGS. 11–15 illustrate another embodiment of the present invention. This particular embodiment is designed to facilitate easy, inexpensive production while reinforcing the strength of the anchor. Ground anchor 100 includes cylindrical section 102, anchor shaft 104, and anchor body 106.

The cylindrical section 102 has a first end which supplies a driving surface 108 for the anchor 100, and a second end which provides an attachment surface 110 for the anchor shaft 104. The driving surface 108 may be used for coupling to an applicator in a similar manner to the socket 20 of FIG. 2. In one embodiment, cylindrical section 102 has a hollow core and includes hole 112 such that fluid can pass through the cylindrical section 102 and exit the hole 112. This is advantageous in the galvanizing process where the cylindrical section 102 can be immersed in galvanizing solution, and when it is removed from the solution, any solution remaining in the hollow core will drain through the hole 112. This draining action prevents the hollow core from becoming clogged as a result of galvanization. Thus, an applicator for driving the anchor 100 into the ground can be inserted without first being forced to drill out the cylindrical section 102.

Anchor shank 104 includes a first end, second end, connection feature 114, first prong 116, second prong 118, and dividing section 120. The first end of the anchor shank 104 couples to the cylindrical section 102 at the attachment point 110. In one embodiment this is accomplished by welding, but other attachment techniques can be used. The connection at the attachment point 110 is only required to support the downward force applied to the anchor 100 when it is driven into the ground, as tension of the connecting member or chain will be directed immediately to the anchor shank 104 via the connection feature 114.

Connection feature 114 is positioned near the first end, extending away from the central axis of the anchor shank 104. The connection feature 114 is used to couple the anchor 100 to the connecting member or chain. First prong 116 is positioned at the second end and aligned with the connection feature 114 such that the clearance required to insert the anchor 100 into a ground hole is minimized. The first prong 116 is formed such that an angled shoulder 117 exists, extending away from the central axis. Second prong 118, which is also located at the second end, is on the opposite side of the shank from the first prong 116. As FIG. 14A clearly illustrates, the two prongs form a fork-like structure that creates a recessed gap that extends upward from the second end of the anchor shank 104. The second prong 118 is structured such that a flush surface is maintained along the side of the anchor shank 104 opposite the connection feature 114. The flush surface is maintained through the alignment of the cylindrical section 102 and the positioning of the anchor body 106 in the pre-set condition. The flush surface aids in minimizing the size of the hole that may have to be drilled in order to insert the anchor 100 into the ground.

Figure 14A:
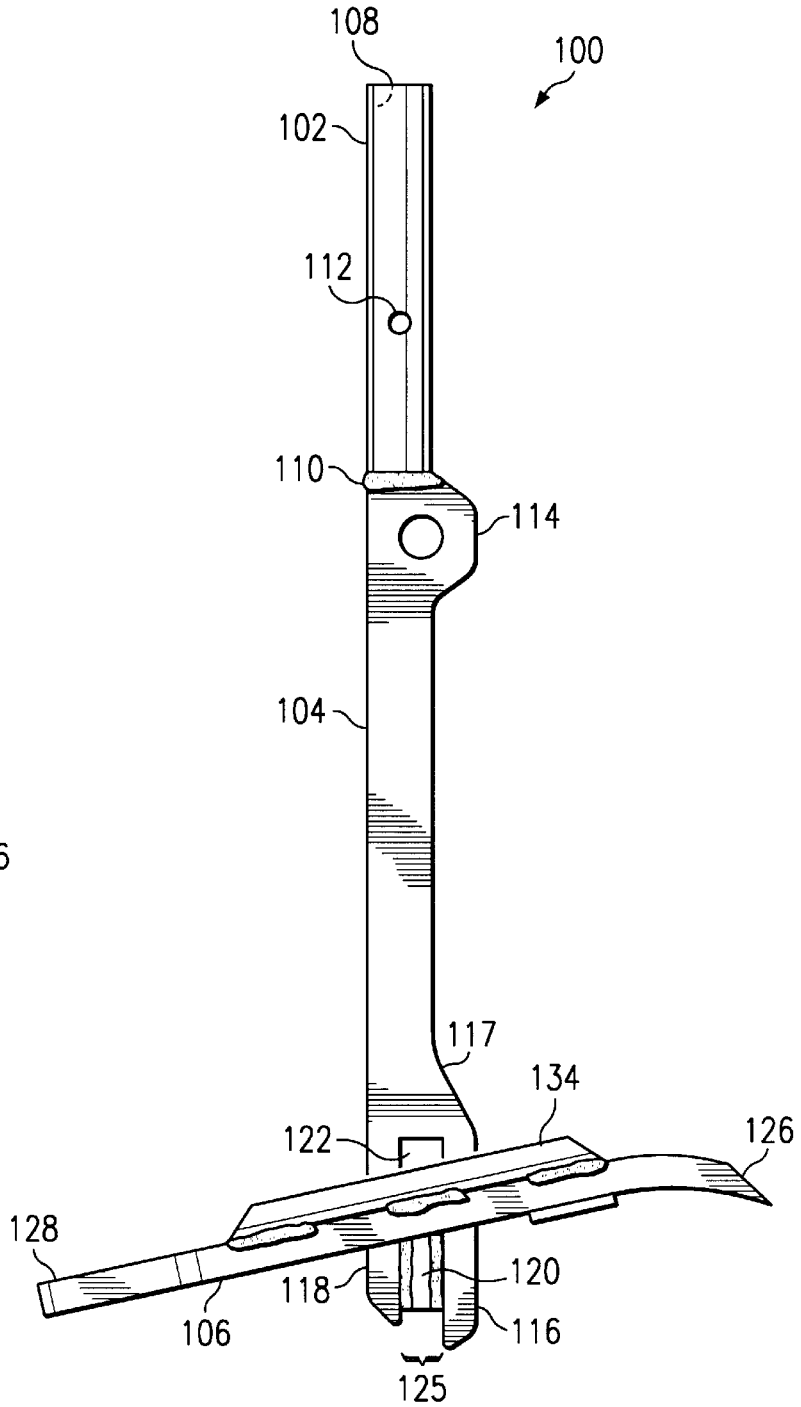
FIG. 14A illustrates a side view of the embodiment of FIG. 11 according to the teachings of the present invention after the anchor is set.

Dividing section 120, which is illustrated in FIG. 14A, is attached to the anchor shaft 104 across the recessed gap between the first prong 116 and the second prong 118. The dividing section 120 divides the recessed gap into a pivot slot 122 and a recessed shoulder 125. The anchor body 106 is pivotally connected to the anchor shaft 104 at the pivot slot 122. In one embodiment, the pivotal connection is accomplished by inserting the anchor body 106 into the recessed gap of the anchor shank 104 before welding the dividing section 120 into place.

Figure 11:
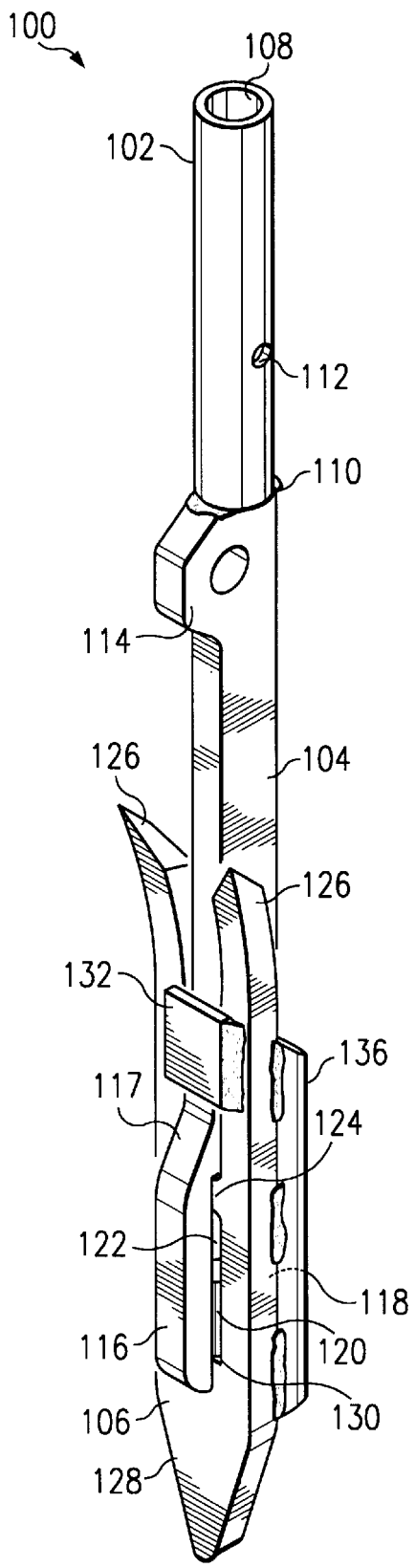
FIG. 11 illustrates a perspective view of another embodiment of a ground anchor according to the teachings of the present invention.
Figure 12:
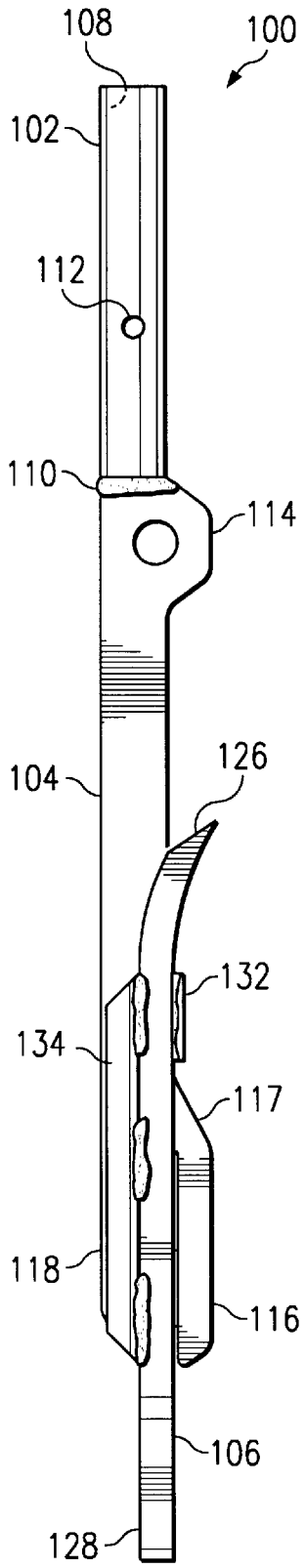
FIG. 12 illustrates a side view of the embodiment of FIG. 11 according to the teachings of the present invention.
Figure 13:
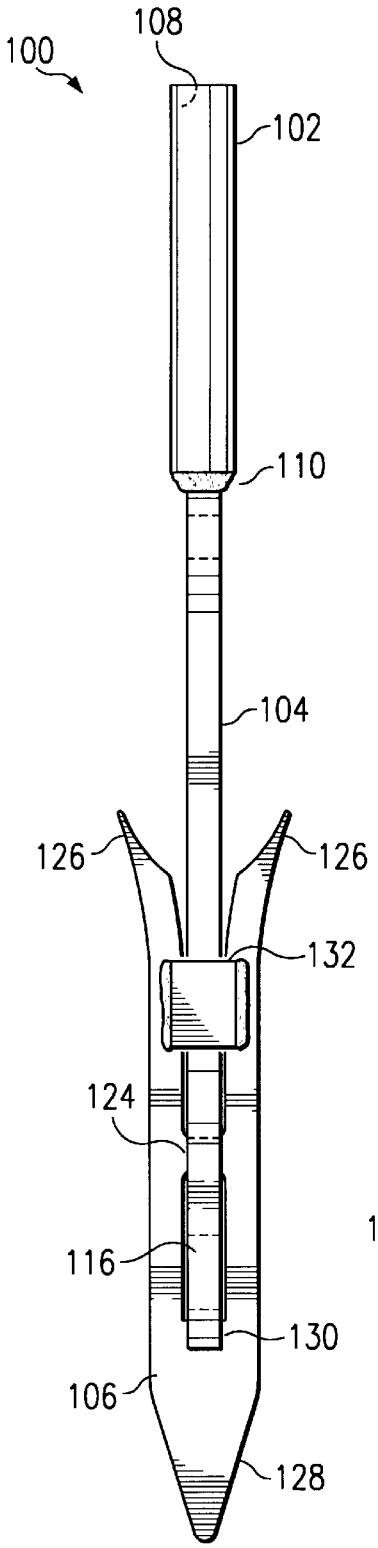
FIG. 13 illustrates a front view of the embodiment of FIG. 11 according to the teachings of the present invention before the anchor is set.
Figure 14B:
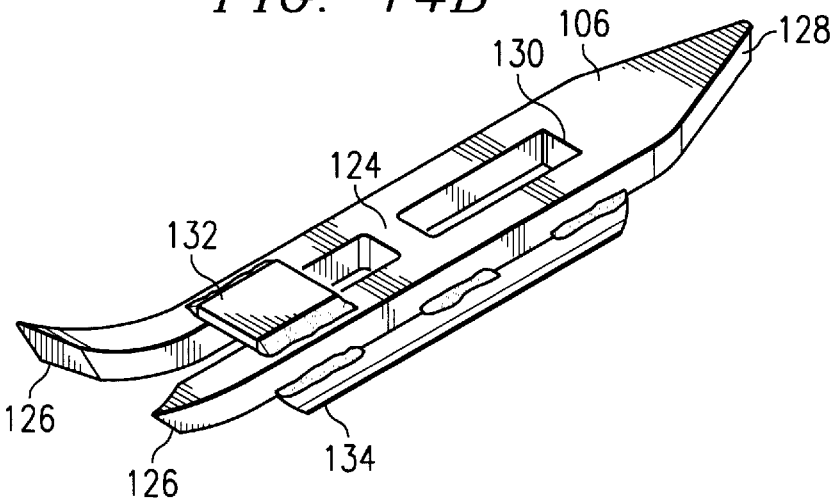
FIG. 14B illustrates details of the anchor body of the embodiment of FIG. 11 according to the teachings of the present invention.

As is illustrated in FIG. 14B, the anchor body 106 includes pivot pin 124, angled portion 126, and leading end 128 which includes anchor body shoulder 130. When the anchor 100 is in the pre-set state, as illustrated in FIGS. 11–13, the anchor body shoulder 130 is engaged with the recessed shoulder 125 between the first prong 116 and the second prong 118 of the anchor shaft 106. This engagement prevents the anchor body 106 from rotating during insertion into the ground. Leading end 128 may be beveled, pointed, or shaped in another manner to facilitate insertion into the ground.

Figure 15:
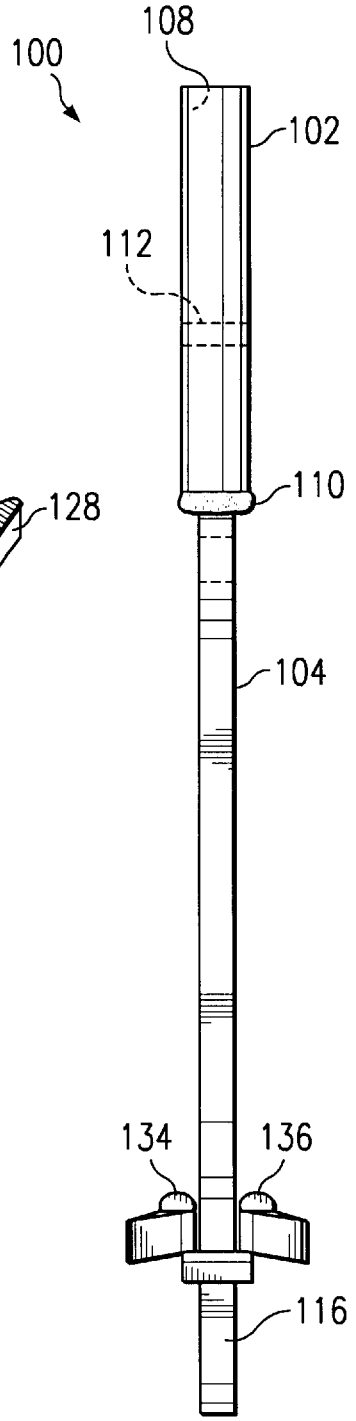
FIG. 15 illustrates a front view of the embodiment of FIG. 11 according to the teachings of the present invention after the anchor is set.

Angled portion 126 is used to engage the ground as the anchor body 106 pivots or rotates between the pre-set state of FIGS. 11–13 and the set state of FIGS. 14A and 15. In order to promote engagement with the ground, the angled portion 126 is structured in a fork-like manner with prongs that are angled away from each other with respect to the plane of the anchor body 106 as well as angled away from the planar surface of the anchor body 106. When the anchor 100 is in the pre-set state, the angled portion 126 does not extend beyond the connection feature 114, which would increase the clearance requirements of the anchor 100. The prongs of the angled portion 126 may be beveled or pointed to further promote engagement with the ground.

In one embodiment, the anchor body 106 is reinforced in a manner which enhances its strength without increasing its clearance requirements. This is accomplished by attaching a prong reinforcement block 132 across the two prongs of the angled portion 126 on the same side that the prongs extend away from the planar surface. This prong reinforcement block 132 also acts to engage angled shoulder 117. Additional reinforcement is achieved by attaching a first anchor body reinforcing block 134 and a second anchor body reinforcing block 136 on the face of the anchor body 106 opposite the prong reinforcing block 132. The anchor body reinforcing blocks 134 and 136 lie along the sides of the anchor body 106 perpendicular with and adjacent to the pivot pin 124. When the anchor 100 is in the set state, reinforcement is supplied proximate the center of the anchor body 106, thus reducing the risk of buckling. When the anchor 100 is in the pre-set state, the anchor body reinforcing blocks 134 and 136 do not extend past the flush surface of the anchor shaft 104 and therefore do not increase the cross-sectional requirements for insertion.

When the anchor body 106 is positioned in the preset state, it is essentially parallel with the anchor shaft 104. Once the anchor has been driven into the ground to the desired depth, tension is applied to the connection member or chain, which causes the anchor shank to be pulled upward. This upward movement causes the angled portion 126 of the anchor body 106 to engage the ground and force the anchor body 106 to pivot about the pivot pin. In one embodiment, this pivoting action may be initiated or encouraged when the angled shoulder 117 encounters the prong reinforcing block 132 as the anchor shaft 104 is pulled upward. The angled shoulder 117 forces the anchor body 106 to rotate such that the angled portion 126 is forced outward from the central axis of the anchor 100, thus encouraging engagement with the ground and transition from the pre-set state to the set state. As is illustrated in FIG. 14A, the second prong 118 may be shorter than the first prong 116 such that as the anchor body shoulder 130 moves out of the recessed shoulder 125, rotation is only allowed in the direction approaching the set state.

An added improvement of the embodiment illustrated in FIGS. 11–15 over the prior art is the reduced cost and complexity of manufacturing the ground anchor. In the illustrated embodiment, the anchor shank 104, the anchor body 106, the dividing section 120, the prong reinforcing block 132, and the anchor body reinforcing blocks 134, 136 can be cut from a sheet of metal or from flat metal pieces. The metal sheet or pieces may be scrap iron, stainless steel, or any other similar metal, and the metal sheet or pieces may vary in thickness. In one embodiment, sheet metal of one-inch thickness is used.

In order to achieve the angled portion 126 of the anchor body 106 from a flat piece of metal, the prongs of the angled portion 126 may be bent away from the plane of the anchor body 106 after it has been cut. The reinforcing blocks 132, 134, and 136 can be attached to the anchor body 106 by welding or another attachment process. The dividing section 120 is attached to the anchor shank 104 in a similar manner after the anchor body 106 has been inserted into the recessed gap of the anchor shank 104.

In summary, a ground anchor is provided having anchor shank that includes a connection point for attachment of connecting member, the connection point being remote from a pivot point of an anchor body. By making the connection point remote from the pivot point, the anchor of the present invention has a smaller cross section than conventional anchors of comparable strength. Furthermore, the present invention provides for a locking mechanism between the anchor body and anchor shank, thus avoiding premature setting of the anchor during insertion of the anchor into the ground. Furthermore, an applicator tool is provided for allowing the anchor of the present invention to be inserted a desired distance into the ground. Also provided is a hollow embodiment to facilitate jetting operations. An additional embodiment is provided which is both easy and cost-efficient to manufacture and which employs reinforcing material for added strength.

The particular shape of various members of the present invention may be changed without departing from the intended scope. For example, the anchor shank and other members may have a round, square, polygon, elliptical, or other shaped cross section.

Although the present invention has been described in detail, it should be understood that various modifications, substitutions, or alterations can be made without departing from the intended scope as defined by the appended claims.

What is claimed is:

1. An anchor for anchoring a structure to ground, the anchor operable to couple to the structure through a connecting member, the anchor comprising:

a cylindrical section having a first end and a second end, wherein the first end provides a driving surface for the anchor and the second end provides an attachment surface, the cylindrical section having a hole proximate the second end, remote from the attachment surface, the cylindrical section having a hollow core;

an anchor shank having:

a first end and a second end, the first end of the anchor shank connected to the attachment surface of the cylindrical section at an attachment point;

a connection feature positioned proximate the first end of the anchor shank, remote from the attachment point and offset from a central axis of the anchor shank, the connection feature for coupling the connecting member to the anchor shank; and a pivot slot positioned proximate the second end and offset from the central axis of the anchor shank in the same direction as the connection feature, such that the pivot slot is substantially in-line with the connection feature; and an anchor body pivotally connected to the anchor shank at the pivot slot, the anchor body having:

a first end and a second end, the anchor body connected to the pivot slot intermediate the first end and the second end of the anchor body;

the first end of the anchor body formed with an angled portion such that when the anchor is in a pre-set state, the angled portion extends away from the central axis of the anchor shank in the same direction as the offset of the connection feature, the angled portion for engaging with the ground when the anchor is set;

the anchor having the pre-set state when the anchor body is pivoted in the pivot slot to be parallel with the cylindrical section and the anchor shank, with the first end of the anchor body extending towards the first end of the anchor shank, and with the anchor body substantially in-line with the connection feature and the pivot slot; and the anchor having a set state in which the anchor body is pivoted in the pivot slot to no longer be parallel with the cylindrical section and the anchor shank.

2. The anchor of claim 1, wherein the second end of the anchor shank includes a recessed shoulder for engaging with the anchor body.

3. The anchor of claim 1, wherein the anchor shank includes an angled shoulder positioned between the connection feature and the pivot slot, the angled shoulder extending away from the center axis of the anchor shank and extending towards the second end of the anchor shank to form an acute angle, wherein when force is applied to the connection member away from the second end of the anchor shank, the angled shoulder forces the anchor to begin transitioning between the pre-set state and the set state.

4. The anchor of claim 1, wherein the second end of the anchor body includes a beveled leading edge.

5. The anchor of claim 1, wherein the angled portion of the first end of the anchor body has a forked shape with prongs angled away from each other with respect to a plane of the anchor body as well as being angled away from the central axis in the same direction as the connection feature.

6. The anchor of claim 5, wherein the prongs of the angled portion are beveled.

7. An anchor for anchoring a structure to ground, the anchor operable to couple to the structure through a connection member, the anchor comprising:

a cylindrical section having a first end and a second end, wherein the first end provides a driving surface for the anchor and the second end provides an attachment surface;

an anchor shank having:

a first end and a second end, the first end of the anchor shank connected to the attachment surface of the cylindrical section at an attachment point such that one side of the anchor shank is placed flush with one side of the cylindrical section to form a flush surface;

a connection feature that extends away from a central axis of the anchor shank opposite the flush surface, the connection feature positioned proximate to the first end of the anchor shank, remote to the attachment point, the connection feature for coupling the connecting member to the anchor shank;

a first prong offset from the central axis of the anchor shank opposite the flush surface, the first prong proximate the second end of the anchor shank, extending in a direction away from the first end of the anchor shank, parallel to the central axis of the anchor shank;

a second prong offset from the central axis of the anchor shank in the direction of the flush surface such that one side of the second prong furthest from the central axis of the anchor shank is part of the flush surface, the second prong proximate the second end of the anchor shank, extending in a direction away from the first end of the anchor shank, parallel to the central axis of the anchor shank, wherein the second prong and the first prong are separated by a recessed gap extending from the second end of the anchor shank; and a dividing section positioned between the first prong and the second prong across the recessed gap, wherein the dividing section divides the recessed gap into a pivot slot and a recessed shoulder, the recessed shoulder proximate to the second end of the anchor shank, the pivot slot opposite the dividing section from the recessed shoulder; and an anchor body pivotally connected to the anchor shank, the anchor body having:

a first end, a second end, a top face, a bottom face opposite the top face, a first side, and a second side opposite the first side, wherein the anchor body is connected to the pivot slot intermediate the first end and the second end of the anchor body;

the first end of the anchor body formed with an angled portion that extends away from the central axis of the anchor shank in the direction of the bottom face, the angled portion for engaging with the ground when the anchor is set;

the anchor having a pre-set state in which the anchor body is pivoted in the pivot slot to be parallel with the cylindrical section and the anchor shank with the first end of the anchor body extending towards the first end of the anchor shank and to be substantially inline with the connection feature and the pivot slot, wherein the top face of the anchor body is proximate the second prong of the anchor shaft; and the anchor having a set state in which the anchor body is pivoted in the pivot slot to no longer be parallel with the cylindrical section and the anchor shank.

8. The anchor of claim 7, wherein the second end of the anchor body includes a beveled leading edge.

9. The anchor of claim 7 wherein the anchor shank, the anchor body, and the dividing section are cut from a piece of metal, wherein the anchor body is pivotally connected to the anchor shank when the dividing section is positioned across the recessed gap after the anchor body has been pivotally placed within the recessed gap.

10. The anchor of claim 7 further comprising:

a first anchor body reinforcing block attached to the anchor body on the top face between the first side and the pivot slot; and a second anchor body reinforcing block attached to the anchor body on the top face between the second side and the pivot slot, wherein the first anchor body reinforcing block and the second anchor body reinforcing block reinforce the anchor body in the set state.

11. The anchor of claim 7, wherein the angled portion of the first end of the anchor body has a forked shape with prongs angled away from each other with respect to a plane of the anchor body as well as being angled away from the central axis in the same direction as the connection feature.

12. The anchor of claim 11, wherein the first prong is formed such that an angled shoulder is formed between the connection feature and the pivot slot, the angled shoulder extending away from the center axis of the anchor shank and extending towards the second end of the anchor shank to form an acute angle, wherein when force is applied to the connection member away from the second end of the anchor shank the angled shoulder forces the anchor to begin transitioning between the pre-set state and the set state.

13. The anchor of claim 12, wherein the second prong of the anchor shank is shorter than the first prong such that initial rotation of the anchor body is only permitted in a direction towards the set state.

14. The anchor of claim 12 further comprising a prong reinforcement block attached to the anchor body on the bottom face across the prongs of the anchor body, wherein when the force is applied to the connection member away from the second end of the anchor shank, the prong reinforcement block contacts the angled shoulder to force the anchor to begin transitioning between the preset state and the set state.

15. The anchor of claim 14 further comprising:

a first anchor body reinforcing block attached to the anchor body on the top face between the first side and the pivot slot; and a second anchor body reinforcing block attached to the anchor body on the top face between the second side and the pivot slot, wherein the first anchor body reinforcing block and the second anchor body reinforcing block reinforce the anchor body in the set state.

16. The anchor of claim 15, wherein when the anchor is in the pre-set position, the first anchor body reinforcing block and the second anchor body reinforcing block do not extend past the flush surface.

17. The anchor of claim 15, wherein the anchor shaft, the anchor body, the dividing section, the prong reinforcing block, the first anchor body reinforcing block, and the second anchor body reinforcing block are cut from a sheet of metal.

18. The anchor of claim 17, wherein the first end of the anchor body is bent after being cut from the sheet of metal to form the angled portion.

19. The anchor of claim 15 wherein the dividing section is welded to the anchor shaft and wherein each of the prong reinforcing block, the first anchor body reinforcing block and the second anchor body reinforcing block are welded to the anchor body.

20. The anchor of claim 11, wherein the prongs of the angled portion are beveled.

* * * * *